US008045910B2

(12) United States Patent
Choi et al.

(10) Patent No.: US 8,045,910 B2
(45) Date of Patent: Oct. 25, 2011

(54) LIGHT ABSORPTION DEVICE, FIXING UNIT COMPRISING THE LIGHT ABSORPTION DEVICE AND IMAGE FORMING APPARATUS COMPRISING THE FIXING UNIT

(75) Inventors: Sun-Rock Choi, Hwaseong-si (KR); Dae-Hwan Kim, Seoul (KR); Seung-Jin Oh, Seoul (KR); Joo-Ho Kim, Suwon-si (KR); Woo-Kyu Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 58 days.

(21) Appl. No.: 12/604,105

(22) Filed: Oct. 22, 2009

(65) Prior Publication Data

US 2010/0111580 A1 May 6, 2010

(30) Foreign Application Priority Data

Nov. 3, 2008 (KR) ..... 10-2008-0108470

(51) Int. Cl.
*G03G 15/20* (2006.01)

(52) U.S. Cl. ..... 399/333; 399/331; 219/216; 492/46

(58) Field of Classification Search ..... 399/122, 399/320, 328–331, 333; 492/46, 49, 53–54; 219/216, 220; 313/15
See application file for complete search history.

(56) References Cited

U.S. PATENT DOCUMENTS 4,842,944 A * 6/1989 Kuge et al. ..... 428/451
5,055,884 A 10/1991 Ndebi et al.
6,344,272 B1 2/2002 Oldenburg et al.
6,838,140 B1 1/2005 Heeks et al.
2002/0011475 A1 1/2002 Haneda et al.
2005/0007001 A1* 1/2005 Imholt et al. ..... 313/231.31
2006/0292360 A1* 12/2006 Hays et al. ..... 428/323
2007/0201915 A1* 8/2007 Maeda et al. ..... 399/333
2008/0176289 A1 7/2008 Zeng et al.
2008/0219727 A1 9/2008 Seol

FOREIGN PATENT DOCUMENTS

JP 2003-313506 11/2003
JP 2003-315531 11/2003
JP 2004-198665 7/2004
JP 2005-038625 2/2005
JP 2005-097581 4/2005

OTHER PUBLICATIONS

Office Action mailed Feb. 22, 2011 in U.S. Appl. No. 12/502,601.
Office Action mailed Oct. 29, 2010 in U.S. Appl. No. 12/502,601.
Office Action mailed Sep. 14, 2010 in U.S. Appl. No. 12/502,601.

(Continued)

*Primary Examiner* — David Porta
*Assistant Examiner* — Benjamin Schmitt
(74) *Attorney, Agent, or Firm* — Staas & Halsey LLP

(57) ABSTRACT

Disclosed are a light absorption device, a fixing unit including the same and an image forming apparatus including such fixing unit. The light absorption device includes a plurality of dielectric layers containing nano-rods. Surface plasmon resonance generated in response to certain wavelengths corresponding to the dielectric constants of the dielectric layers can result in an improvement in the light absorption efficiency. Further improvements can be realized by adjusting the dielectric constants of the dielectric layers.

10 Claims, 6 Drawing Sheets

OTHER PUBLICATIONS

European Office Action dated Aug. 27, 2010 and issue in European Patent Application 09164388.2.

Hone et al. "Electrical and Thermal Transport Properties of Magnetically Aligned Single Wall Carbon Nanotube Films." Applied Physic Letters: American Institute of Physics, vol. 77, No. 5, pp. 666-668, Jul. 31, 2000.

Ye et al. "Microwave Absorption by an Array of Carbon Nanotubes: A Phenomological Model." Physical Review: The American Physical Society, B 74, 075425, pp. 1-5, 2006.

U.S. Appl. No. 12/625,150, filed Nov. 24, 2009, Oh et al., Samsung Electronics Co., Ltd.

U.S. Appl. No. 12/502,601, filed Jul. 14, 2009, Kim, Samsung Electronics Co., Ltd.

* cited by examiner

LIGHT ABSORPTION DEVICE, FIXING UNIT COMPRISING THE LIGHT ABSORPTION DEVICE AND IMAGE FORMING APPARATUS COMPRISING THE FIXING UNIT

CROSS-REFERENCE TO RELATED PATENT APPLICATION

This application claims the benefit of Korean Patent Application No. 10-2008-0108470, filed on Nov. 3, 2008, in the Korean Intellectual Property Office, the disclosure of which is incorporated herein by reference in its entirety.

TECHNICAL FIELD

The present disclosure relates generally to a light absorption device with improved heat efficiency, a fixing unit incorporating such light absorption device and an image forming apparatus employing such fixing unit.

BACKGROUND OF RELATED ART

A light absorption device absorbs light emitted from a light source, and may be used as a heating device converting the energy of absorbed light into heat. For example, a light absorption device may be used in a fixing unit of an electrophotographic image forming apparatus.

An electrophotographic image forming apparatus charges photosensitive drums substantially uniformly, and exposes so charged photosensitive drums with light, e.g., using a laser scanning unit (LSU), to thereby form an electrostatic latent image in correspondence to the image to be formed. The electrostatic latent image is developed with developer, e.g., charged toner, into a visible toner image, which is then transferred onto a recording medium. At this point, the toner image transferred onto the recording medium is not yet permanently fixed, but is merely being carried on the recording medium. A fixing unit may be utilized to thermally fuse or otherwise fix the toner image on the recording medium by the application of heat and pressure to thereby complete the formation of the image on the recording medium. For example, when a roller-type fixing unit is used, the recording medium carrying the toner image is passed through a nip formed between a heating roller and a pressurizing roller that are in a pressing contact each other, and is allowed to be heated by the heating roller and at the same time to be pressed by the heating roller and the pressurizing roller. The heating roller is an example of a light absorption device, and may be of the form of a cylindrical metal roller that is heated by a heat source, such as, for example, a halogen lamp.

SUMMARY OF THE DISCLOSURE

According to an aspect of the present disclosure, there is provided a light absorption device that may comprise a plurality of dielectric layers containing therein one or more nano-rods, respective dielectric constants of at least two of the plurality of dielectric layers being different from one another.

The one or more nano-rods may comprise at least one metal selected from the group consisting of Ag, Au, Pt, Pd, Fe, Ni, Al, Sb, W, Tb, Dy, Gd, Eu, Nd, Pr, Sr, Mg, Cu, Zn, Co, Mn, Cr, V, Mo, Zr and Ba.

The plurality of the dielectric layers may comprises a first dielectric layer and a second dielectric layer. The first dielectric layer may have dispersed therein one or more first nano-rods. The second dielectric layer may be formed on the first dielectric layer. The second dielectric layer may have dispersed therein one or more second nano-rods.

In one embodiment, the one or more first nano-rods and the one or more second nano-rods may have substantially the same aspect ratio.

The first dielectric layer may have a first dielectric constant. The second dielectric layer may have a second dielectric constant different from the first dielectric constant.

According to an embodiment, the plurality of the dielectric layers may comprise a first dielectric layer and a second dielectric layer. The one or more nano-rods may be arranged at the interface boundary between the first and the second dielectric layers.

The light absorption device may further comprise a light source that may be configured to produce light and to illuminate the light on the plurality of dielectric layers.

The light produced by the light source may have a plurality of wavelengths.

The plurality of dielectric layers may comprise a first dielectric layer and a second dielectric layer. The first dielectric layer may have a first dielectric constant that allows a first light absorption rate of ones of the one or more nano-rods contained in the first dielectric layer to be substantially at its maximum in response to a first light component having a first peak wavelength. The second dielectric layer may have a second dielectric constant different from the first dielectric constant. The second dielectric constant allows a second light absorption rate of ones of the one or more nano-rods contained in the second dielectric layer to be substantially at its maximum in response to a second light component having a second peak wavelength different from the first peak wavelength. Each of the first and second peak wavelengths may be within the range of the plurality of wavelengths of the light produced by the light source.

According to another aspect of the present disclosure, a fixing unit for fixing a toner image on a recording medium may be provided to include a light source that may be configured to generate light, a heating member and a pressurizing member. The heating member may be configured to receive the light generated by the light source, and to apply heat to the toner image. The heating member may comprise a plurality of dielectric layers that contains one or more nano-rods. The pressurizing member may be arranged to opposingly face the heating member so as to form a fixing nip with the heating member.

In an embodiment, the heating member may comprise a belt.

The light source may be arranged outside the heating member. The plurality of dielectric layers may be formed in an outer portion of the heating member.

The light source may in the alternative be formed inside the heating member. The plurality of dielectric layers may be formed in an inner surface of the heating member.

The heating member may comprise a heat guide member that surrounds at least a portion of the light source so as to absorb the light generated by the light source. The plurality of dielectric layers may be formed on the surface of the heat guide member that faces the light source.

According to yet another aspect, an image forming apparatus may be provided to include a printing unit and a fixing unit. The printing unit may be configured to transfer a toner image to a recording medium, the toner image being a pattern of toner representative of an image. The fixing unit may be configured to fix the toner image onto the recording medium. The fixing unit may comprise a light source that may be configured to produce light, a heating member and a pressurizing member. The heating member may be configured to receive the light produced by the light source, and to apply heat to the toner image. The heating member may comprise a plurality of dielectric layers that contains one or more nano-rods. The pressurizing member may be arranged to opposingly face the heating member so as to form a fixing nip with the heating member.

BRIEF DESCRIPTION OF THE DRAWINGS

Various features and advantages of the present disclosure will become more apparent by describing in detail exemplary embodiments thereof with reference to the attached drawings in which.

DETAILED DESCRIPTION OF SEVERAL EMBODIMENTS

Figure 1:
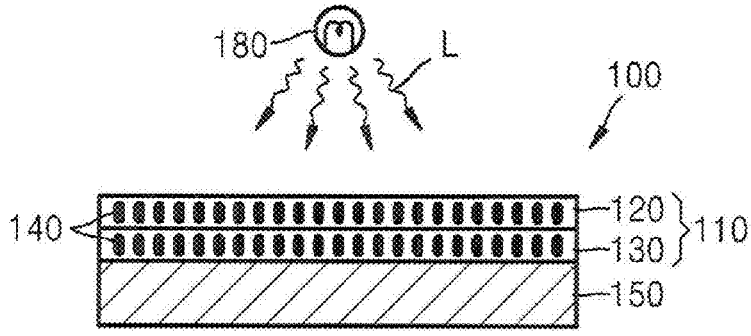
FIG. 1 schematically illustrates the structure of a light absorption device according to an embodiment of the present disclosure.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

Referring first to FIG. 1, a light absorption device according to an embodiment my include a light absorbing unit 100 and a light source 180.

The light absorbing unit 100 may include a substrate 150 and a light absorbing layer 110 formed on the substrate 150. The substrate 150 may be coated with the light absorbing layer 110, and, depending on the particular application, may itself be the object to be heated or an intermediate member for further transferring the heat. The light absorbing layer 110 absorbs the energy of incident light L, and may convert the light energy into thermal energy. According to an embodiment, the light absorbing layer 110 may include the first and second dielectric layers 120 and 130, in each of which a plurality of nano-rods 140 may be dispersed.

The light source 180 may be configured to irradiate light L onto the dielectric layers 120 and 130, and may be a multi-wavelength light source, such as, for example, a halogen lamp.

A nano-rod as referred to herein is a nano-sized rod having a size that may range from few nanometers (nm) to several hundred nanometers. Surface plasmon resonance is known to occur at an interface between a dielectric material having positive dielectric characteristics and a dielectric material having negative dielectric characteristics when the two dielectric materials are brought to contact each other. In particular, the surface plasmon resonance is known to frequently occur in a metal having large negative dielectric characteristics. The nano-rods according to an embodiment may be formed of a metal capable of generating the surface plasmon resonance. For example, the nano-rods may be formed of a metal selected from the group consisting of Ag, Au, Pt, Pd, Fe, Ni, Al, Sb, W, Tb, Dy, Gd, Eu, Nd, Pr, Sr, Mg, Cu, Zn, Co, Mn, Cr, V, Mo, Zr and Ba, or a various compound or alloys of the afore-listed metals. The surface plasmon resonance induced by the metal nano-rods is well known in the art, and thus detailed description thereof will be omitted herein.

Figure 2:
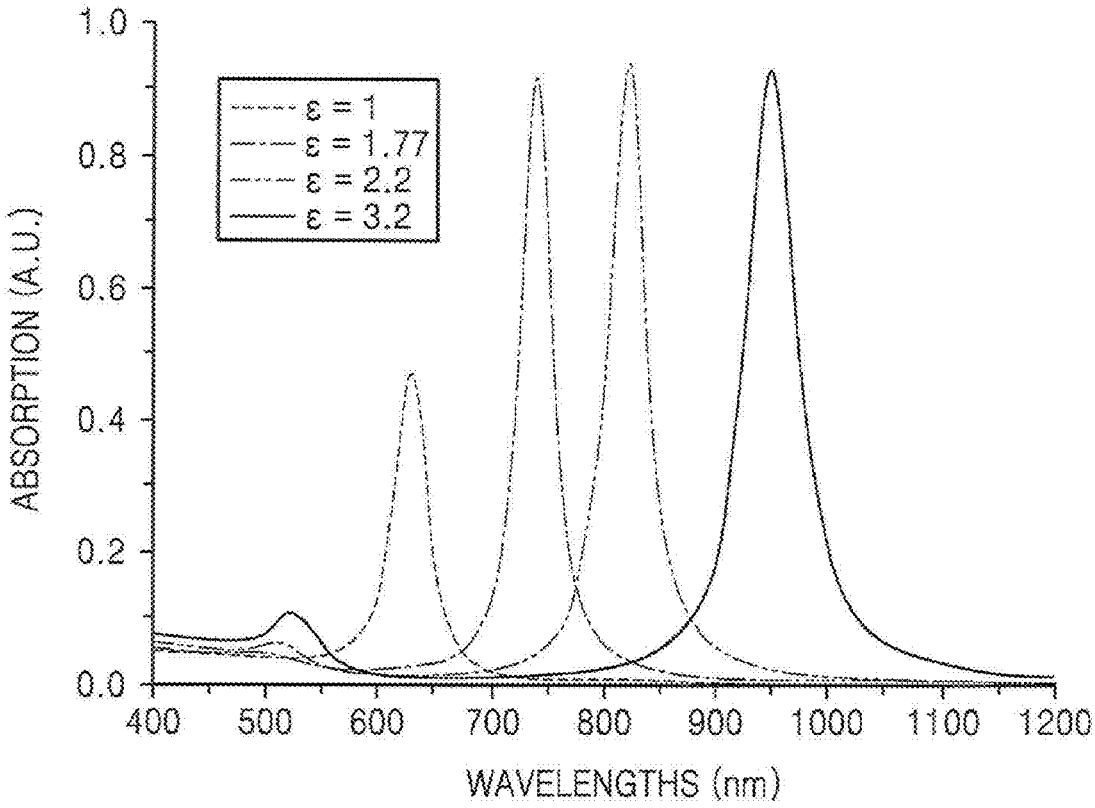
FIG. 2 is a graph of the wavelengths and the light energy absorption for various dielectric constants of the dielectric layer in which nano-rods are dispersed.

When surface plasmon resonance occurs, reflections or diffusions of light incident on the nano-rods are suppressed, resulting in the maximum light energy absorption of the nano-rods, and promoting an efficient photo-thermal energy conversion. The wavelength of the light at which the surface plasmon resonance occurs can vary according to the aspect ratio of the nano-rods. Also, even when the aspect ratio of the nano-rods kept uniform, the wavelength at which the light generates the surface plasmon resonance can vary according to the dielectric constant of the medium that surrounds the nano-rods. Referring to FIG. 2, for example, it can be observed from the graphs that the wavelength at which the light energy absorption is at the maximum varies with varying dielectric constants of the dielectric layer in which the nano-rods are dispersed.

Referring again to FIG. 1, the light absorbing layer 110, in which a plurality of nano-rods is dispersed, may absorb the energy of the light L incident thereon, and may convert the light energy into thermal energy. In the example shown in FIG. 1, the first and the second dielectric layers 120 and 130 may have different dielectric constants. A halogen lamp, which can be used as the light source 180, emits light that may have a relatively broad range of wavelengths. According to an aspect of the present disclosure, the light energy absorption efficiency can thus be effectively increased by varying the dielectric constants of the dielectric layers, for example, in the example of FIG. 1, the first and the second dielectric layers 120 and 130, in each of which the nano-rods 140 may be dispersed, so that the wavelength at which the light absorption by the nano-rods 140 peaks is in the range of wavelengths of the light emitted from the halogen lamp.

Figure 3:
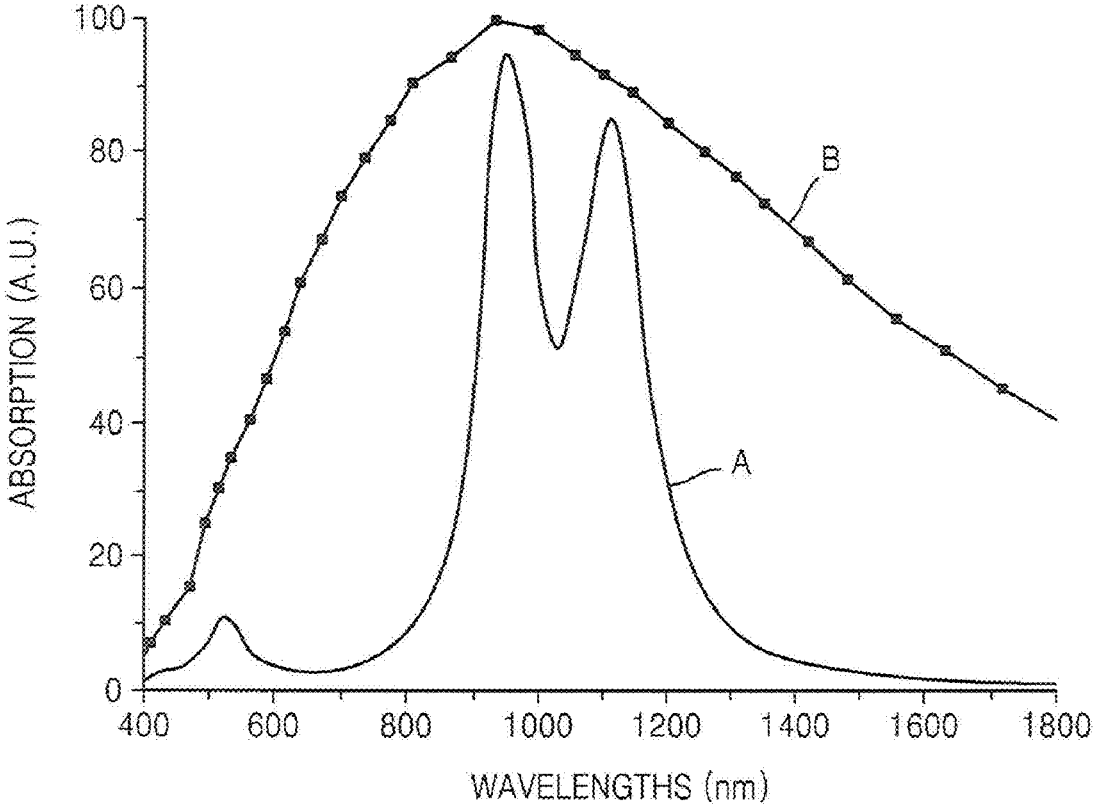
FIG. 3 is a graph of the light absorption ratio as a function of the wavelengths of the from a halogen lamp irradiated on a plurality of dielectric layers of the light absorption device of FIG. 1.

An example of the light absorption rate at various wavelengths when a halogen lamp is used to irradiate light on the light absorbing layer 110 of FIG. 1 is plotted in FIG. 3. In FIG. 3, the curve labeled 'A' refers to the proportional amount of light absorbed in the light absorbing layer 110 as a function of the wavelengths while the curve labeled 'B' refers to the intensity of light irradiated from the halogen lamp. By way of an example, according to an embodiment, the first dielectric layer 120 may be formed of glass while the second dielectric layer 130 may be formed of flint glass containing 70% lead. In such configuration, the dielectric constants of the first and second dielectric layers 120 and 130 may be 1.5 and 1.8, respectively. The nano-rods 140 dispersed in the light absorbing layer 110 may be formed of, for example, gold (Au), and may be of a cylindrical shape with a diameter of 10 nm and a length of 50 nm, for example. The number of the nano-rods 140 dispersed per $mm^2$ of the first and second dielectric layers 120 and 130 may be about $1.5\times10^8$, for example. Referring to FIG. 3, the first peak observed at around 950 nm corresponds to the nano-rods 140 of the above-described construction that are dispersed in the first dielectric layer 120. The second peak observed at around 1100 nm corresponds to the nano-rods 140 dispersed in the second dielectric layer 130. With such configuration of the light absorbing layer 110, by allowing the peaks to occur at wavelengths that are within the wavelength spectrum of the light from the halogen lamp, the light absorption rate can be increased.

According to an embodiment, the light absorbing layer 110 may be formed of two or more dielectric layers, for example, as shown in FIG. 1, the first and second dielectric layers 120 and 130. When the light absorbing layer 110 is formed of three or more dielectric layers, the light absorption can be increased also by adjusting the dielectric constants of the dielectric layers such that the peak wavelengths of absorbed light energy are within the range of the wavelength spectrum of the light source 180.

According to an embodiment, when the dielectric constants of the dielectric layers, for example, the first and second dielectric layers 120 and 130 of FIG. 1, are each selected to adjust the wavelength at which the light energy absorption is at its maximum, the aspect ratio of the nano-rods 140 dispersed in each of the dielectric layers may be substantially the same. The aspect ratios of the nano-rods 140 may be identical within a range of tolerance or error in the manufacturing process, that is, the nano-rods 140 that are manufactured under the same process conditions would typically have substantially the same aspect ratios. According to an embodiment, the aspect ratios of the nano-rods 140 are substantially the same, but the present disclosure need not be so limited. For example, nano-rods of different aspect ratios may be dispersed in different dielectric layers or even within the same dielectric layer. For example, when the first and second dielectric layers 120 and 130 of FIG. 1 have dispersed therein nano-rods having different aspect ratios, the wavelengths at which the light energy absorption is at its maximum can still be adjusted by varying the dielectric constants of the first and second dielectric layers 120 and 130.

Figure 4:
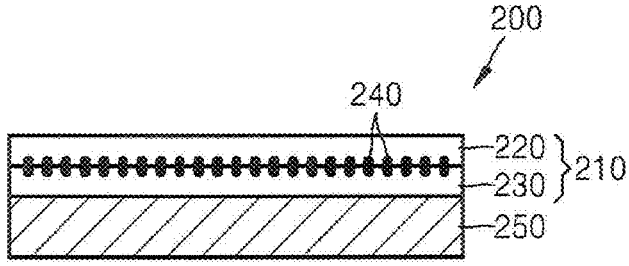
FIG. 4 schematically illustrates a light absorption device according to another embodiment.

FIG. 4 is a schematic view illustrative of a light absorption device 200 according to another embodiment. Referring to FIG. 4, the light absorption device 200 according to an embodiment may include a substrate 250, on which a light absorbing layer 210 is formed. The light absorbing layer 210 may include the first and second dielectric layers 220 and 230, at the interface boundary of which nano-rods 240 may be dispersed. In FIG. 4, the nano-rods 240 are shown to be arranged at a different position within the light absorbing layer 210 in comparison to the previously described embodiments, however other features can be substantially the same as with the previous embodiments, and thus description of the same features will not be repeated.

As previously described, the peak wavelength of the absorbed light may vary according to the dielectric constant of the medium around the nano-rods 240. Accordingly, even when the nano-rods 240 are arranged only at the interface between the first and second dielectric layers 220 and 230 as, for example, shown in FIG. 4, the peak wavelength of the absorbed light can nevertheless be adjusted by adjusting the dielectric constants of the first and second dielectric layers 220 and 230.

While according to an embodiment, the light absorbing layer 210 is shown and described as having a two-layered structure, other embodiments implementing three layers or more structure of the light absorbing layer 210 are also possible.

Figure 5:
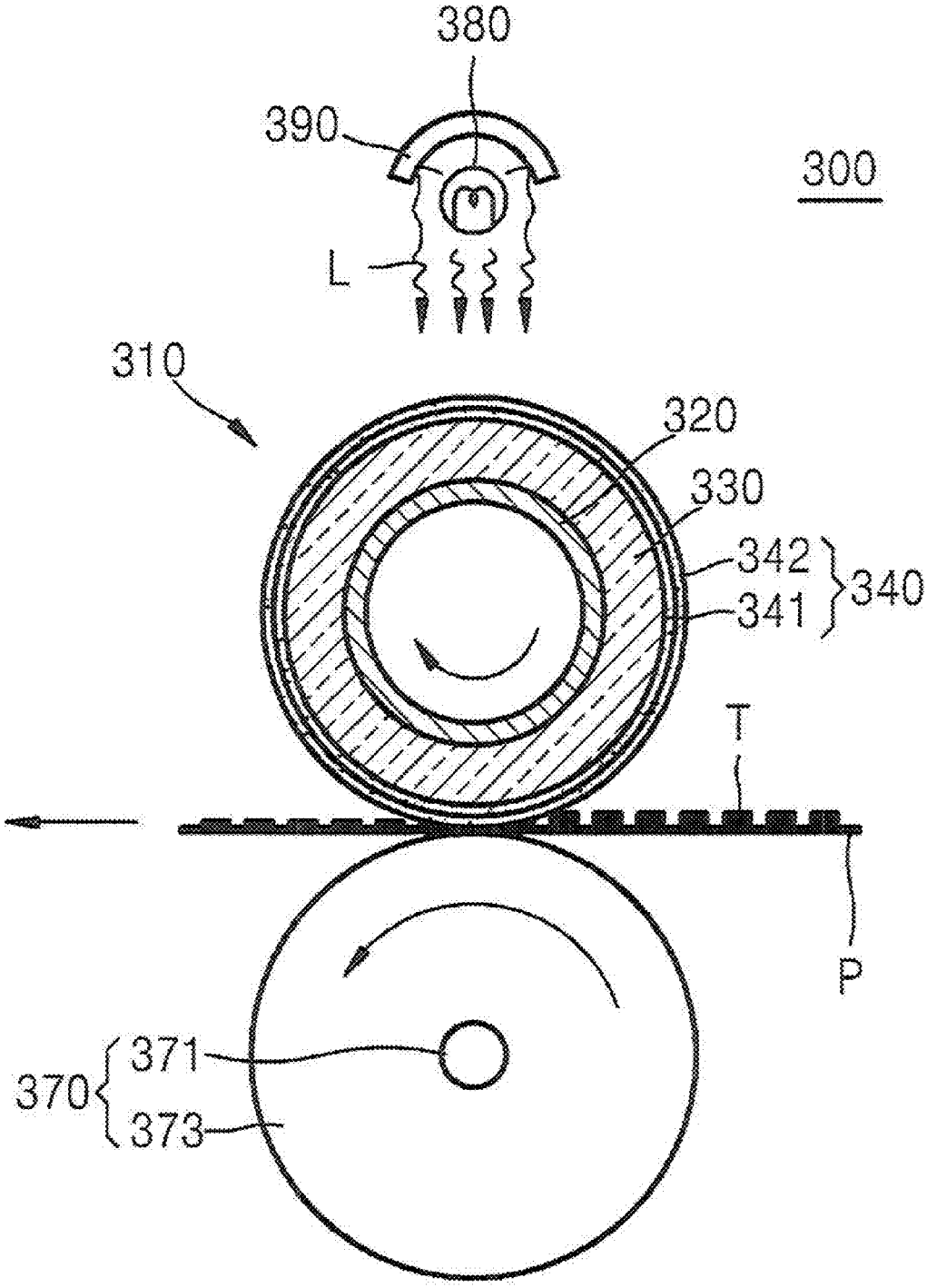
FIG. 5 schematically illustrates a fixing unit according to an embodiment.

FIG. 5 is a schematic view illustrating a fixing unit 300 according to an embodiment.

Referring to FIG. 5, the fixing unit 300 according to an embodiment may include a heating roller 310, a pressurizing roller 370 and a light source 380.

The heating roller 310 is a cylinder-shaped unit that can be configured to rotate about its longitudinal axis in a direction, for example, indicated by the arrow shown in FIG. 5, and may include an inner pipe 320, an elastic layer 330 and a light absorbing layer 340.

The inner pipe 320 may form the base rotational structure of the heating roller 310 on which the outer layers are supported, and may be a core pipe formed of, for example, iron, steel, stainless steel, aluminum, copper, an alloy, ceramics, fiber reinforced metal (FRM), or the like. The above configuration of the inner pipe 320 is described only as an example, and not as a limitation. For example, a rod-shaped shaft may alternatively be used instead of the inner pipe 320.

The elastic layer 330 may be formed on the outer circumferential surface of the inner pipe 320. The elastic layer 330 may be formed of, for example, silicone rubber, fluorine rubber, or the like. Examples of the silicone rubber may include room temperature vulcanized (RTV) silicone rubber, heat temperature vulcanized (HTV) silicone rubber, or the like. In some specific embodiments, polydimethyl silicone rubber, metal vinyl silicone rubber, metal phenyl silicone rubber, fluoro-silicone rubber, or the like, may be used.

The light absorbing layer 340 may formed of a plurality of dielectric layers 341 and 342 in which a plurality of nano-rods are dispersed. In FIG. 5, two dielectric layers 341 and 342 are illustrated, but the number of the dielectric layers may be three or more. As previously described, the nano-rods are capable of generating surface plasmon resonance with respect to an incident light, which can improve the efficiency of a photo-thermal energy conversion. The light absorbing layer 340 may be substantially the same as the light absorbing layer 110 of FIG. 1 or the light absorbing layer 210 of FIG. 4, and thus repeated description thereof is unnecessary.

A releasing layer (not shown) may further be formed on the outer circumferential surface of the light absorbing layer 340, and may be formed of a releasing resin such as, for example, fluorine rubber, silicone rubber, fluorine resin, or the like. The releasing layer allows an easier separation of the recording medium P from the heating roller 310 during the fixing process. According to an alternative embodiment, a dielectric material having releasing properties may be used as the outermost dielectric layer of the light absorbing layer 340.

The pressurizing roller 370 may be a cylindrical shaped member configured to be rotatable about the metal core 371, which is surrounded by a heat-resistant elastic layer 373 formed of silicone rubber, for example. A fixing nip may be formed between the pressurizing roller 370 and the heating roller 310. The heat from the heating roller 310 and the pressure between the pressurizing roller 370 and the heating roller 310 allow fusing of the toner image T onto the recording medium P as the recording medium P is made to pass through the fixing nip between the pressurizing roller 370 and the heating roller 310.

The light source 380 is configured to produce heat, and may be, for example, a halogen lamp. According to an embodiment, a reflection member 390 may further be arranged in the fixing unit 300, and may be configured to direct the light emitted by the light source 380 toward the heating roller 310.

The light source 380 according to an embodiment may be formed outside the heating roller 310 to supply the heat directly to the outer circumferential surface of the heating roller 310. Since the radiated heat is received directly by the outer circumferential surface of the heating roller 310 that includes the light absorbing layer 320, the temperature at the surface of the heating roller 310 can be raised more quickly. Thus, by increasing the surface temperature of the heating roller 310 up to the fixing temperature, which may be, for example, in the range of 180° C. through 200° C., over a shorter period of time, which makes a faster first page out time (FPOT) that is the time taken to print the first printing medium during a printing process, which may increase the overall printing speed.

A halogen lamp, as an example of the light source 380, may produce light with a relatively broad range of wavelengths. The light energy absorption efficiency of the fixing unit 300 can be improved by varying the dielectric constants of the plurality of dielectric layers in which the nano-rods are dispersed so that the peak wavelength of the absorption spectrum of the nano-rods is within the range of wavelengths of the light emitted from the halogen lamp.

Figure 6:
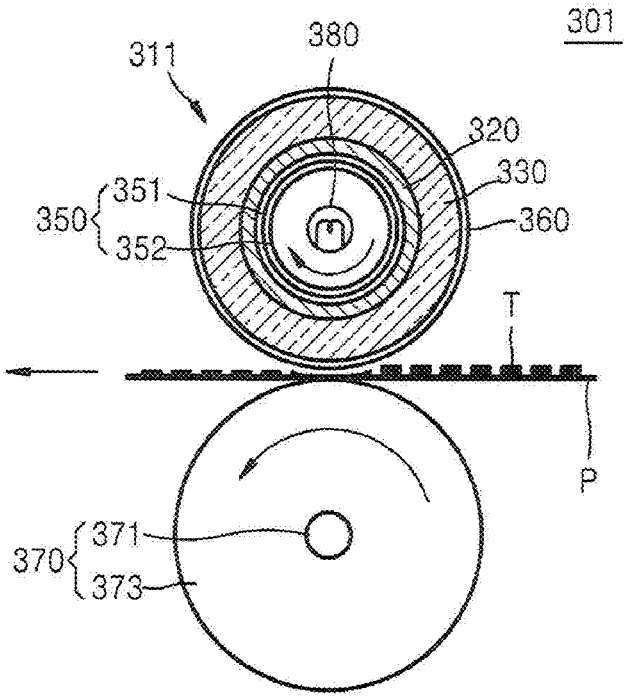
FIG. 6 schematically illustrates a fixing unit according to another embodiment of the present disclosure.

FIG. 6 is a schematic view illustrating a fixing unit 301 according to another embodiment of the present disclosure.

Referring to FIG. 6, the fixing unit 301 according to an embodiment may include a heating roller 311, a pressurizing roller 370 and a light source 380. Like reference numerals in FIGS. 5 and 6 denote like elements, for which detailed description will not be repeated for brevity.

The light source 380 may be arranged inside the pressurizing roller 311. To this end, a tubular shaped core is formed as an internal pipe 320 of the heating roller 311. With such configuration of the light source 380 being inside the internal pipe 320, one or more light absorbing layers 350 may be formed on the inner circumferential surface of the inner pipe 320 so as to directly absorb light emitted from the light source 380. A releasing layer 360 may further be formed on the outer circumferential surface of the heating roller 311.

According to an embodiment, the light absorbing layer 350 may be formed of a plurality of dielectric layers, in each of which a plurality of nano-rods are dispersed. While, in the example shown in FIG. 6, two dielectric layers 351 and 352 are shown, the light absorbing layer 350 may however be formed of three or more dielectric layers. The light absorbing layer 350 may be substantially the same as the light absorbing layer 110 previously described in reference to FIG. 1 or the light absorbing layer 210 previously described in reference to FIG. 4.

Figure 7:
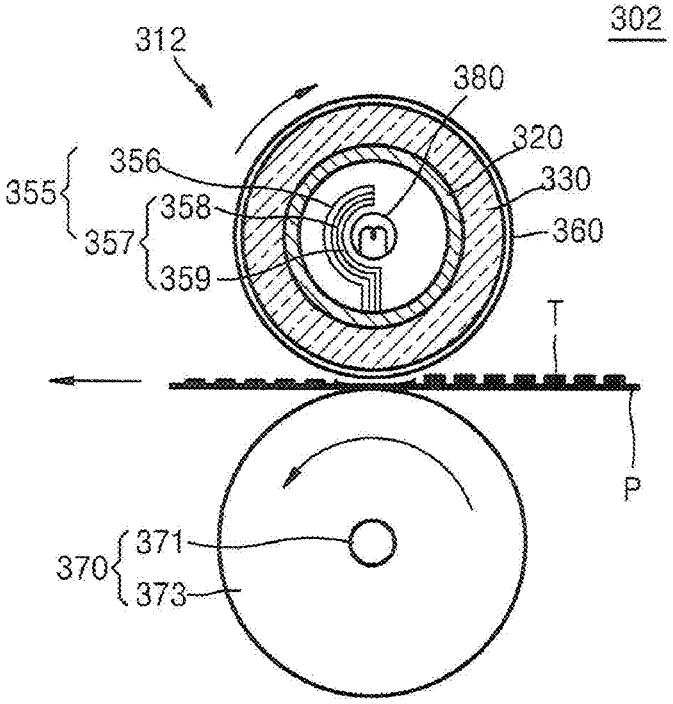
FIG. 7 schematically illustrates a fixing unit according to yet another embodiment of the present disclosure.

FIG. 7 is a schematic view illustrating a fixing unit 302 according to another embodiment of the present disclosure.

Referring to FIG. 7, the fixing unit 302 according to an embodiment may include a heating roller 312, a pressurizing roller 370 and a light source 380. The fixing unit 302 includes a heat guide member 355 surrounding at least a portion of the light source 380 inside the heating roller 312, and has no light absorbing layer formed the inner circumferential surface of the heating roller 312. Other features of the fixing unit 302 may be substantially the same as the embodiments previously described in reference to the fixing unit 301 of FIG. 6.

The heat guide member 355 may include a support 356 and a light absorbing layer 357 formed on the surface of the support 356 that faces the light source 380. The light absorbing layer 357 may include a plurality of dielectric layers 358 and 359 in each of which a plurality of nano-rods are dispersed. The light absorbing layer 357 is substantially the same as the light absorbing layer 110 previously described in reference to FIG. 1 or the light absorbing layer 210 previously described in reference to FIG. 4, and thus the description thereof need not be repeated. The support 356 may be formed of a metal having good thermal conductivity in order to transfer the energy of light, that is, heat, absorbed in the light absorbing layer 357. An end of the heat guide member 355 contacts the inner circumferential surface of the heating roller 312 and transfers heat from the light source 380 therethrough. The end of the heat guide member 355 contacting the inner circumferential surface of the heating roller 312 may be positioned in proximity to the fixing nip between the heating roller 312 and the pressurizing roller 370.

The heat guide member 355 may be configured to surround the whole light source 380 or only a portion of the light source 380. According to an embodiment, as shown in FIG. 7, the upstream side of the heat guide member 355, which is the side where the printing medium P enters the fixing nip, is open so that the upstream side of the inner circumferential surface of the heating roller 312 can be heated directly by the light source 380. With such configuration, the upstream side of the heating roller 312 may be heated preliminarily by the direct radiation of the light source 380 while the intensity of heat can be increased at the fixing nip by the heat guide member 355, thereby increasing the heat efficiency.

While the embodiments shown in FIGS. 6 and 7 is described above as including no light absorbing layer on the inner circumferential surface of the heating roller, in alternative embodiments, one or more light absorbing layers may be formed on the inner circumferential surface of the heating roller to further increase the light absorption efficiency.

Figure 8:
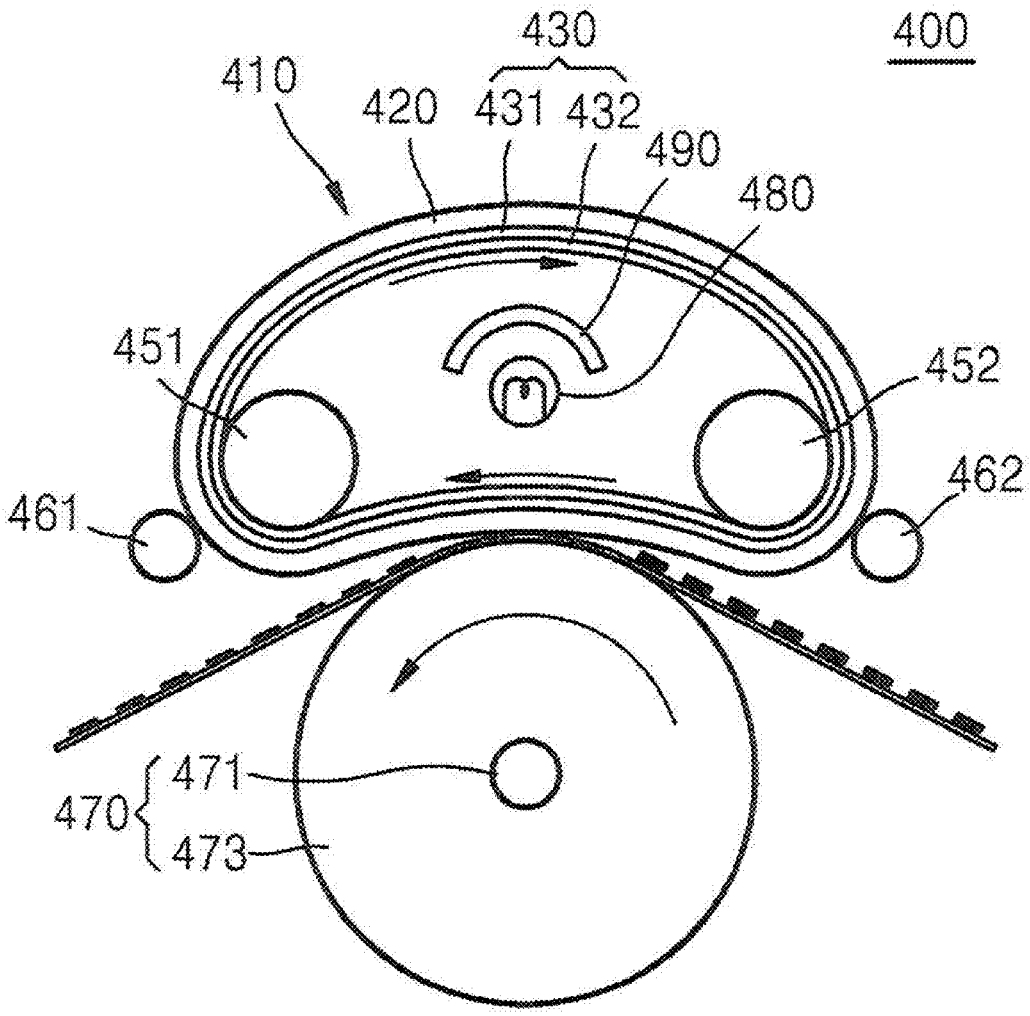
FIG. 8 schematically illustrates a fixing unit according to even yet another embodiment of the present disclosure.

FIG. 8 is a schematic view illustrating a fixing unit 400 according to another embodiment of the present disclosure.

The fixing unit 400 according to an embodiment may include a heating belt 410, a pressurizing roller 470 and a light source 480. Unlike the previously described embodiments in which a heating roller is used, a heating belt 410 may be used as a heating member.

The pressurizing roller 470 and the light source 480 may be substantially the same as the pressurizing rollers and the light sources of the previously described embodiments in reference to FIGS. 5 through 7, and thus need not be described again in detailed.

The heating belt 410 may have a width that is wider than the width of the recording medium P, and may form a generally cylindrical shape with a relatively shallow thickness. A driving roller 451 and a guide roller 452 may be arranged inside the heating belt 410. Pinch rollers 461 and 462 may be formed outside the heating belt 410. The driving roller 451 and the guide roller 452 support the heating belt 410 in place in cooperation with the pinch rollers 461 and 462.

The heating belt 410 may include a light absorbing layer 430 formed on the inner circumferential surface of a base layer 420, which may be formed of a metal or a thermal resin film of a thickness of several tens to about 150 μm. The light absorbing layer 430 may include a plurality of dielectric layers 431 and 432 in which a plurality of nano-rods are dispersed. The light absorbing layer 430 may be substantially the same as the light absorbing layer 110 or the light absorbing layer 210 as previously described, and the description thereof thus need not be repeated. According to an embodiment, an elastic layer (not shown) formed of heat-resistant rubber such as, for example, silicone may be further stacked on the outer surface of the base layer 420. Further, a releasing layer formed of, for example, Teflon may be further stacked on the surface of the elastic layer, or, if no elastic layer is used, on the outer surface of the base layer 420.

The inner surface of the heating belt 410 may be in a frictional contact with the driving roller 451 so as to be rotationally driven by the driving roller 451 that rotates about its longitudinal rotational axis, and may thus rotate in generally a circular or elliptical loop. The guide roller 452 may also be in a frictional contact with the heating belt 410, and may support the heating belt 410 so as to maintain a tension in the section of the heating belt 410 in the vicinity of the fixing nip formed between the heating belt 410 and the pressurizing roller 470.

The fixing unit 400 may further include a reflection member 490. The reflection member 490 directs the light emitted from the light source 480, in the form of radiant heat, toward the section of the heating belt 410 around the fixing nip.

In FIG. 8, the light source 480 is shown to be arranged inside the heating belt 410. However, the light source 480 may alternatively or additionally be arranged outside the heating belt 410. In such case, a light absorbing layer may be formed on the outer surface of the heating belt 410 in lieu of or in addition to the light absorbing layer on the inner surface of the heating belt 410. According to an embodiment, the reflection member 490 may take the form of the heat guide member 355 shown in FIG. 7, and as described above. In such embodiment, as previously described, the heat guide member may include a light absorbing layer, and the light absorbing layer 430 can be eliminated from the inner surface of the heating belt 410.

Figure 9:
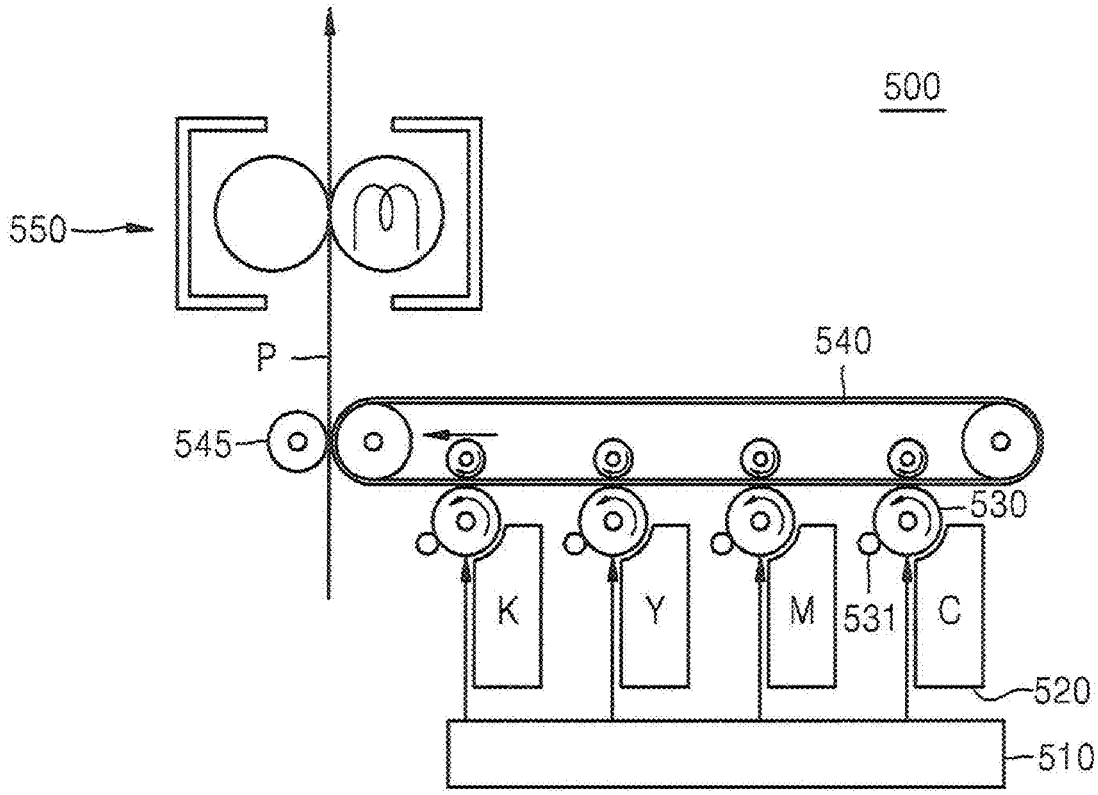
FIG. 9 schematically illustrates an image forming apparatus according to an embodiment of the present disclosure.

FIG. 9 schematically illustrates an image forming apparatus 500 according to an embodiment of the present disclosure.

Referring to FIG. 9, the image forming apparatus 500 may include a light scanning unit 510, developing units 520, photosensitive drums 530, charging rollers 531, an intermediate transfer belt 540, a transfer roller 545 and a fixing unit 550. The fixing unit 550 may be a fixing unit according to the embodiments previously described in reference to FIGS. 5 through 8.

The light scanning unit 510 may scan a light, which may be modulated according to the image to be formed, on the photosensitive drums 530, the surface of may have previously been charged to a substantially uniform potential by the charge roller 531. The photosensitive drum 530 may be an example of a photoreceptor, and may include a photosensitive layer of a predetermined thickness formed over the outer circumferential surface of a cylinder metal pipe. The outer circumferential surface of the photosensitive drum 530 is the surface on which the light from the light scanning unit 510 is scanned to thereby form an electrostatic latent image. According to an embodiment, a photosensitive belt may instead be used as the photoreceptor. Toner contained in the developing unit 520 may be transported to the photosensitive drum 530 in response to a developing bias voltage applied between the developing unit 520 and the photosensitive drum 530, resulting in the development of the electrostatic latent image into a visible toner image. According to an embodiment, to print a color image, each of the developing units 520 and the photosensitive drums 530 may respectively correspond to one of several colors. The light scanning unit 510 scans four lights respectively to the four photosensitive drums 530 to thereby form electrostatic latent images corresponding to the image information of black (K), magenta (M), yellow (Y) and cyan (C) colors on each of the photosensitive drums 530, respectively. The four developing units 520 may supply toner of black (K), magenta (M), yellow (Y) and cyan (C) colors, respectively, to the photosensitive drums 530 to form toner images of black (K), magenta (M), yellow (Y) and cyan (C) colors. The charging roller 531 may rotate in contact with the photosensitive drums 530, and charges the surface of the corresponding one of the photosensitive drums 530 to a uniform electrical potential. To that end, a charging bias voltage Vc may be applied to the charging roller 531. A corona charger (not shown) may alternatively be used instead of the charging roller 531.

The toner images formed on the photosensitive drums 530 may be transferred to the intermediate transfer belt 540. The toner images may in turn be transferred to a printing medium P, e.g., a sheet of paper, by a transfer bias voltage applied to the transfer roller 545, as the printing medium P is transported between the transfer roller 545 and the intermediate transfer belt 540. The toner images transferred to the paper P may become fixed on the printing medium P by the heat and pressure from the fixing unit 550 to thereby complete the image formation process.

In the above-described embodiments of image forming apparatus 500, the heat efficiency can be improved by the use of the light absorption device according to the various embodiments described herein in the fixing unit 550. According to an aspect of the present disclosure, by the use of a fixing unit according to the various embodiments herein described, the temperature of such fixing unit can be raised rapidly, making it possible to reduce the FPOT, and to increase the printing speed.

In addition, a light absorption device according to various embodiments herein described may be used in various devices, in addition to a fixing unit of an image forming apparatus, that use radiant heat as the heat source. For example, a light absorption device according to the embodiments may be used in any heating system that uses radiant heat as the heat source. The light absorption device according to the embodiments may also be used in any application that requires an intense heating of a small localized area by irradiating light onto desired local area identified by the inclusion of the nano-rods. Such a localized heating device may be used in various fields such as, for example, in installing electronic components on print circuit boards and in medical diagnostics and/or treatments, for example, in the treatment of cancer by implanting a nano-rods containing identifier in the cancerous tumor to apply localized heat and to thereby destroy the tumor.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A fixing unit for fixing a toner image on a recording medium, comprising:

a light source configured to generate light having a plurality of wavelengths;

a heating member configured to receive the light generated by the light source, and to apply heat to the toner image, the heating member comprising a plurality of dielectric layers that contains one or more nano-rods; and a pressurizing member arranged to opposingly face the heating member so as to form a fixing nip with the heating member, wherein the plurality of dielectric layers comprises at least a first dielectric layer and a second dielectric layer, wherein the first dielectric layer has a first dielectric constant that allows a first light absorption rate of the one or more nano-rods contained in the first dielectric layer to be substantially at a maximum in response to a first light component having a first peak wavelength, wherein the second dielectric layer has a second dielectric constant different from the first dielectric constant, the second dielectric constant allows a second light absorption rate of the one or more nano-rods contained in the second dielectric layer to be substantially at a maximum in response to a second light component having a second peak wavelength different from the first peak wavelength, and wherein each of the first and second peak wavelengths is within a range of the plurality of wavelengths of the light generated by the light source.

2. The fixing unit of claim 1, wherein the one or more nano-rods comprise at least one metal selected from the group consisting of Ag, Au, Pt, Pd, Fe, Ni, Al, Sb, W, Tb, Dy, Gd, Eu, Nd, Pr, Sr, Mg, Cu, Zn, Co, Mn, Cr, V, Mo, Zr and Ba.

3. The fixing unit of claim 1, wherein each of the plurality of the dielectric layers comprise:

a first dielectric layer having dispersed therein one or more first nano-rods; and a second dielectric layer formed on the first dielectric layer, the second dielectric layer having dispersed therein one or more second nano-rods.

4. The fixing unit of claim 3, wherein the one or more first nano-rods and the one or more second nano-rods have substantially the same aspect ratio.

5. The fixing unit of claim 1, wherein the one or more nano-rods are arranged at an interface boundary between the first and the second dielectric layers.

6. The fixing unit of claim 1, wherein the heating member comprises a belt.

7. The fixing unit of claim 1, wherein the light source is arranged outside the heating member, the plurality of dielectric layers being formed in an outer portion of the heating member.

8. The fixing unit of claim 1, wherein the light source is formed inside the heating member, the plurality of dielectric layers being formed in an inner surface of the heating member.

9. The fixing unit of claim 1, wherein the heating member comprises a heat guide member that surrounds at least a portion of the light source so as to absorb the light generated by the light source, the plurality of dielectric layers being formed on a surface of the heat guide member that faces the light source.

10. An image forming apparatus, comprising:

a printing unit configured to transfer a toner image to a recording medium, the toner image being a pattern of toner representative of an image; and a fixing unit configured to fix the toner image onto the recording medium, the fixing unit comprising:

a light source configured to generate light having a plurality of wavelengths;

a heating member configured to receive the light generated by the light source, and to apply heat to the toner image, the heating member comprising a plurality of dielectric layers that contains one or more nano-rods; and a pressurizing member arranged to opposingly face the heating member so as to form a fixing nip with the heating member, wherein the plurality of dielectric layers comprises at least a first dielectric layer and a second dielectric layer, wherein the first dielectric layer has a first dielectric constant that allows a first light absorption rate of the one or more nano-rods contained in the first dielectric layer to be substantially at a maximum in response to a first light component having a first peak wavelength, wherein the second dielectric layer has a second dielectric constant different from the first dielectric constant, the second dielectric constant allows a second light absorption rate of the one or more nano-rods contained in the second dielectric layer to be substantially at a maximum in response to a second light component having a second peak wavelength different from the first peak wavelength, and wherein each of the first and second peak wavelengths is within a range of the plurality of wavelengths of the light generated by the light source.

* * * * *